United States Patent [19]

Moore et al.

[11] 3,977,536

[45] Aug. 31, 1976

[54] CONCRETE CONSTRUCTION METHOD AND APPARATUS USING "FLYING" TRUSS DECK FORMS

[75] Inventors: S. Thomas Moore, Tucson; Eugene N. Carlier, Phoenix, Ariz.

[73] Assignee: M.M. Sundt Construction Company, Tucson, Ariz.

[22] Filed: June 9, 1975

[21] Appl. No.: 585,433

[52] U.S. Cl. ..... 214/1 H; 214/1 D; 249/18; 264/33; 425/62

[51] Int. Cl.[2] ..... E04G 21/00

[58] Field of Search ..... 214/1 H, 1 D; 425/62; 249/18; 264/33

[56] References Cited

UNITED STATES PATENTS

| | | | |
|---|---|---|---|
| 3,899,152 | 8/1975 | Avery | 249/18 |
| 3,902,289 | 9/1975 | Dashew | 52/122 |

*Primary Examiner*—L. J. Paperner
*Assistant Examiner*—George F. Abraham
*Attorney, Agent, or Firm*—Dowell & Dowell

[57] ABSTRACT

Method and apparatus for constructing buildings having multiple poured concrete floors using "flying" truss deck forms, the apparatus including shore jacks fixed to the deck supporting trusses and retractable above the bottoms of the trusses and extensible therebelow to support the deck form on the next lower floor, and including form -supporting dollies having caster-mounted floor engaging wheels and having jacks mounted thereon for supporting the trusses of the deck forms and for raising and lowering the latter and the method including a way of extending a truss beyond the outside edge of the building below the floor which it has just supported so that it can be rigged to a crane and "flown" to the next level to be poured.

4 Claims, 8 Drawing Figures

CONCRETE CONSTRUCTION METHOD AND APPARATUS USING "FLYING" TRUSS DECK FORMS

FIELD OF INVENTION

This invention relates to methods and apparatus for constructing multiple-floor concrete buildings using so-called flying truss deck forms, and more particularly relates to improved methods of handling these forms and to improved shore jacks and dollies for supporting the forms, positioning them in desired pouring locations, stripping them from a cured floor and moving them out beyond the building line where they can be rigged to a crane for flying them to a new location where another floor is to be poured.

BACKGROUND AND PRIOR ART

The usual way of handling a flying truss deck form is to lower it into position from above using a crane, and to support it in the selected pouring location by means of cribbing or multiple high capacity jacks, which jacks are usually made up of several component parts and are very limited in vertical range without changing components, whereby it is necessary to replace some of the component parts in order to change the height range. These supporting jacks are not usually fixed to the trusses of the deck form, but are handled as separate units which are removed from the truss deck form whenever it is being moved to a new location. Once a floor has been poured and cured on these deck forms, each form must have its weight transferred from the shore jacks to independent lowering jacks resembling garage-type hydraulic jacks, or crank operated lowering jacks, which are customarily used as separate equipment not only to support the deck forms from below while the supporting jacks under the trusses are being removed, but which are then used to lower the deck form to strip it from the cured concrete and to place it on multiple dollies, on which the deck form is rolled to the edge of the building and out therebeyond on form glide rollers to a partially extended position where the operation of rigging it to the crane commences. The jacking of the deck form between the dolly level and the pouring level, first to raise it and later to lower it, is most time consuming. Moreover, in the past it has been necessary to remove the supporting jacks from beneath the trusses before they can be rolled on their lower chords over the form glides in order to extend the deck form beyond the building line and out from under the recently poured and cured floor.

The prior art shows various deck form handling and supporting means analagous to individual features of the present invention, but without teaching the combination of apparatus or steps required to achieve present purposes.

For instance, U.S. Pat. No. 3,787,020 to Avery shows small screw jacks attached to the lower beams of a flying truss deck form in such a way that they can be pivoted up above the truss bottoms. These jacks are of very limited range in their capability to change height. The patent shows a technique for moving the form by rolling it on the floor upon which it rests using clamped-on beam rollers which, however, lack steering capability.

U.S. Pat. No. 3,744,945 to Metrailer shows a shallow-truss deck form using very long shore jacks which, however, can not be detached in such a way as to leave the lower truss chords free for rolling on a form glide, because the jacks are mounted on downwardly extending stubs welded to the lower surfaces of the truss beams. Metrailer uses a single carriage for moving the forms about, but it is not steerable except by laboriously changing sets of wheels. Even so, no diagonal movement is possible. Carriage height is adjusted by inflating or deflating its pneumatic tires.

U.S. Pat. No. 3,320,646 to Wilkins shows a pouring form for an arcuate concrete roof which form is rolled around in folded condition on a trailer vehicle and unfolded when it reaches the desired location. Shore jacks then attached to hold the outer form members in extended position and the vehicle has hydraulic jacks to vertically change the height of the form. However, the form is not a flying truss deck form and is not handled in the manner set forth and claimed in this disclosure, but is a modular device moved on the vehicle from one poured bay to the next adjacent one at the same level.

THE INVENTION

The present invention teaches improvements in methods and apparatus for handling, setting and supporting flying truss deck forms, especially as used for constructing high-rise multiple floor poured concrete buildings wherein generally the slab for an entire floor is poured in one sequence on a plurality of truss-type deck forms assembled and shored for this purpose while resting on a previously poured deck below. These deck forms are frequently very large in area, forms up to 24 feet by 70 feet being used on a construction job which is under-way at the present time. In order to be able to remove all such forms after the floor above has been cured a high degree of mobility is necessary in handling them, as well as for placing them initially in desired set positions and for moving them between floors while changing their locations.

It is a principal object of this invention to provide a method and apparatus for handling flying deck forms with a high degree of efficiency and mobility so as to decrease the amount of labor required to remove the deck forms from one set position to the next set position, generally at a new floor level, and to accomplish this purpose with a minimum expenditure of labor and time. Particularly in high-rise construction flying deck forms are not usually relocated on the same floor level, but must be rigged to fly to the next level to be poured. This is because in most cases an entire floor is formed in one sequence of steps using a number of deck forms cooperatively associated. In a practical situation most of the deck forms have some special feature of shape which makes them peculiarly adapted for use at the same bay position on successive floors of a building under construction. At any rate, the object of the present invention is to provide a technique for stripping the form from beneath a cured floor, lowering it, rolling it to the edge of the floor, and extending it beyond the edge of the building for rigging to cables dropped from a crane which will then fly the form to the next set position.

It is another major object of the invention to provide a number of dollies having caster wheels engaging the floor on which the dollies rest and supporting a deck form so that it can be moved freely in any direction by only a few men pushing the form about, the use of multiple separate dollies, and the provision of all of these dollies with long stroke hydraulic jacks for raising and lowering brackets on which the truss frame rests, making it possible to raise and lower the deck form through a full range of heights while the form is still on the dollies, whereby the shoring jacks can be set at the proper elevations without intervention of any other hydraulic or mechanical lifting jacks except those which are an integral part of the supporting dollies.

It is another object of the invention to provide dollies having integrally mounted hydraulic jacks, and to use several of said dollies on each side of the center of gravity of the deck form, whereby the form can be elevated to place one end thereof upon glide rollers at the edge of the building on which the deck form can be pushed out beyond the building line for rigging to a crane. Once one end of the deck form is supported on the form glide rollers at the edge of the building, the leading set of dollies can be removed from beneath the form, and the form can then be pushed outwardly of the building. One approach includes pushing the form outwardly on the glide rollers until it tilts into overbalanced position, the top of the form resting against the bottom of the floor which the form has just supported while curing. The trailing set of dollies is then free to be removed while the form is being rigged to the crane.

Still another object of the invention is to provide shore jacks which are permanently fixed to the truss members supporting the deck form, the shore jacks being of the telescopic type including outer members fixed entirely within the vertical height of the truss, and inner telescopic members which can be retracted into the outer members far enough so that their bottoms also lie above the bottom chord of the truss whereby the shore jacks when retracted leave the bottom chords of the trusses free to roll on the glide rollers located at the edge of the building. It is an important feature of the invention that, unlike most prior art systems, these long extension jacks are fully self-contained, and no part thereof need be removed in order to leave the bottom chords of the trusses free to roll on the glide rollers.

It is another feature of the invention that the shore jacks have a long-extension capability whereby their inner members can be extended below the bottom chords of the trusses far enough to reach all the way to the floor on which the deck forms are being supported, again, whereby no extra parts or blocks need be provided in order to fully support the deck forms ready for pouring.

A further object of the invention is to provide such shore jacks with two degress of adjustment, a coarse degree of adjustment providing an approximately correct level for the base plate of the jack, and a fine degree of adjustment providing fine increments of adjustment between the coarse positions. The shore jacks each have an attached base plate at the lower end of their extensible inner members, and these base plates are swivel mounted in order to plumb the jack on a floor which is off-level.

It is another object of the invention to provide cooperative shore jacks and dolly jacks, which together have predetermined ranges of telescoping capability, whereby the dolly jacks can raise the flying truss deck to the highest level necessary for setting the shore jacks, or lower it sufficiently to be rolled out of the building, and whereby the shore jacks can be extended from their fully retracted positions above the bottom chords of the trusses down to fully extended positions wherein the shore jacks are capable of supporting the flying decks while the next level is being poured. The cooperation of these two different kinds of jacks is of course also closely tied to the height of the trusses which are used beneath the deck forms.

It is a very significant feature of the present invention that no other equipment is required for raising, lowering, or supporting the trusses than the aforementioned shore jacks which are rigidly attached in the correct horizontal locations to the trusses, and the dollies, four of which are usually required in order to achieve complete and efficient handling of a particular flying truss deck form. The cooperation of the shore jacks and the dollies with their jacks makes possible the efficient method of handling of flying truss deck forms as described below in connection with this invention.

Other objects and advantages will become apparent during the following discussion of the drawings, wherein:

THE DRAWINGS

Figure 1:
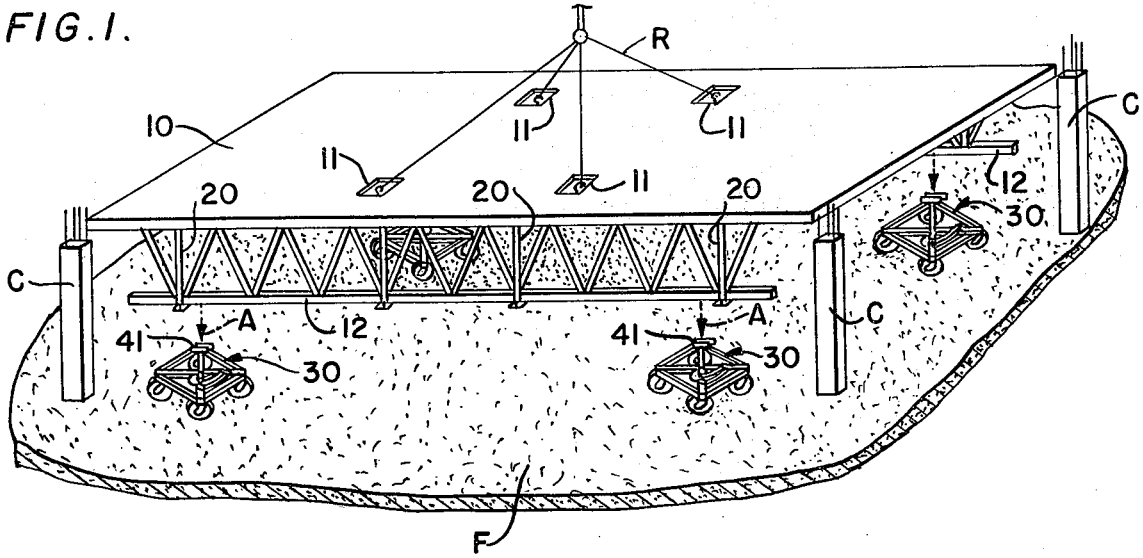
FIG. 1 is a perspective view showing a part of a high-rise building floor having columns extending therefrom, and showing a flying truss deck form being lowered by a crane for support according to the invention on four dollies.
Figure 2:
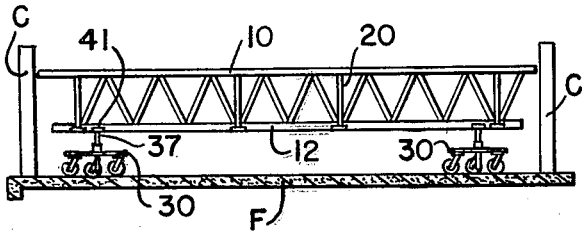
FIG. 2 is a side elevation on a smaller scale showing the deck form supported on the dollies and positioned between building columns.
Figure 3:
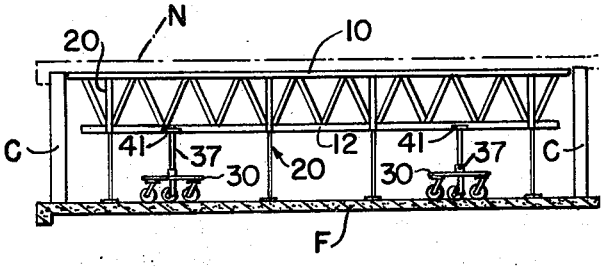
FIG. 3 is an elevation view of the deck form raised by the hydraulic jacks on the dollies to the level required, and showing the shore jacks extended to the floor, the pouring location of a new floor being shown in dashed lines.
Figure 4:
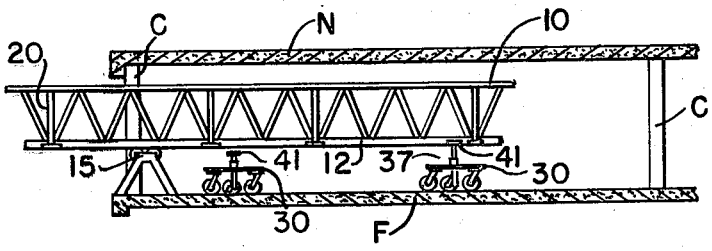
FIG. 4 is a side view showing a flying deck form being rolled outwardly of the building line, supported at one end on glide rollers, and supported at the other end on dollies.
Figure 5:
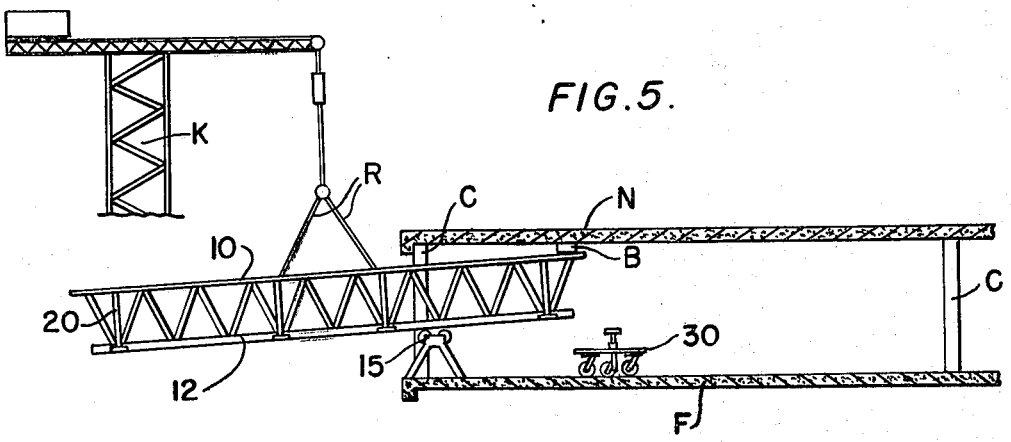
FIG. 5 is a side view showing the flying deck form protruding outwardly beyond the building line in overbalanced position, supported below on the form glide rollers and supported at its top surface against a block inserted between the end of the deck form and the just-completed higher floor of the building, with the last set of dollies disengaged from the deck form.
Figure 8:
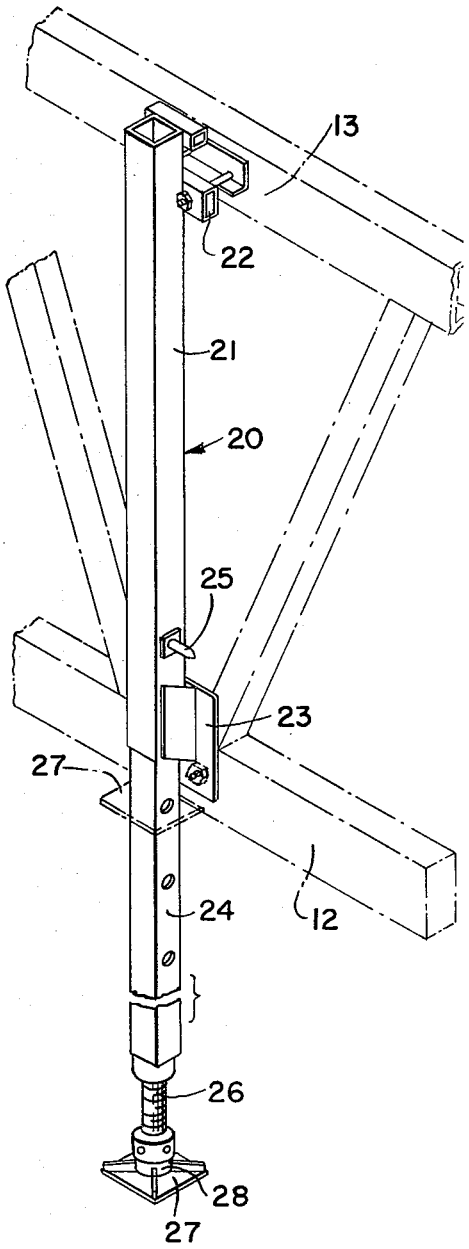
FIG. 8 is a perspective view showing a shore jack according to the invention fixed to a truss (shown in dashed lines) of the type comprising a part of a flying deck form.

Referring now to the drawings, and especially to FIGS. 1 through 5 inclusive, these figures show the floor F of a partially completed building from which columns C extend in the upward direction to support the next floor N which is to be poured joined with the columns C, the next floor N being shown in FIGS. 3, 4 and 5. A flying deck form 10 is shown in several sequential positions, the deck form being in the process of being lowered on crane rigging R as shown in FIG. 1, and being about to be raised using rigging R depending from a crane K as shown in FIG. 5, there being suitable cut-out openings 11 in the deck 10 to pass the rigging R for attachment to the truss work beneath. The flying deck 10 includes supporting truss work beneath the deck, such truss work comprising diagonal braces attached to a bottom chord member 12 and to a top chord member 13 which is best seen in FIG. 8.

A plurality of shore jacks 20 are provided for supporting the deck 10 while the concrete is being poured. As can be seen best in the detailed drawing of FIG. 8, each of the shore jacks 20 comprises an outer hollow-sleeve member 21 having upper mounting means 22 and lower mounting means 23 by which the outer sleeve member 21 is secured respectively to the upper truss member 13 and the lower truss chord 12. Within the outer member 21 there is telescopically received at least one inner slide member 24, and the height of the inner member 24 with respect to the outer member 20 is conveniently adjusted by the insertion of a pin 25, in a manner well known per se in jacks of this type, for instance, as shown in the above-mentioned patent to Metrailer. At the lower end of the slide member 24 there is a screw jack portion 26 carrying a base plate 27 at its lower end, which base plate is preferably attached by a ball-type swivel joint 28. It will be noted that the outer jack member 21 is attached to the truss members 13 and 12 in such a way that when the jack 20 is in fully retracted position, the base plate 27 as shown in dashed lines in FIG. 8 is located above the bottom of the lower truss chord 12. The length of the jack members 21 and 24 as extended by the members 26 and 27 is sufficient that when the jack is in fully extended position the distance between the base plate and the top of the deck 10 is at least as great as the spacing between floors of the building under construction. Thus, as shown in FIG. 10, when fully extended the jacks 20 are capable of supporting the deck 10 as least as high as the bottom of the next floor N which is about to be poured.

Figure 6:
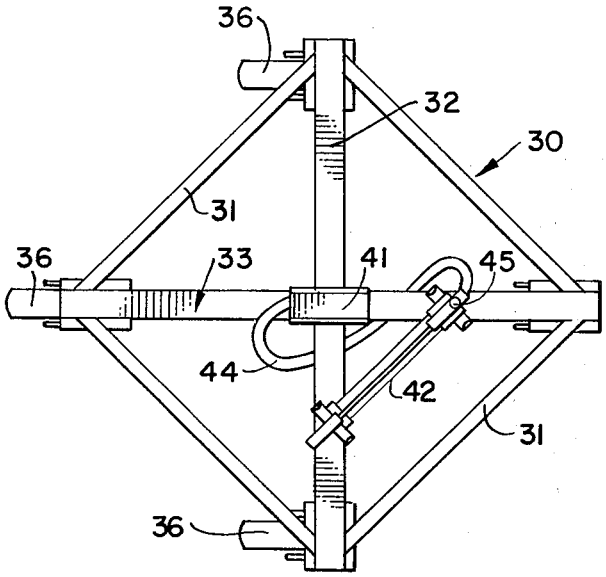
FIG. 6 is a plan view of a dolly of the type used in handling the deck form as shown in FIGS. 1 through 5.
Figure 7:
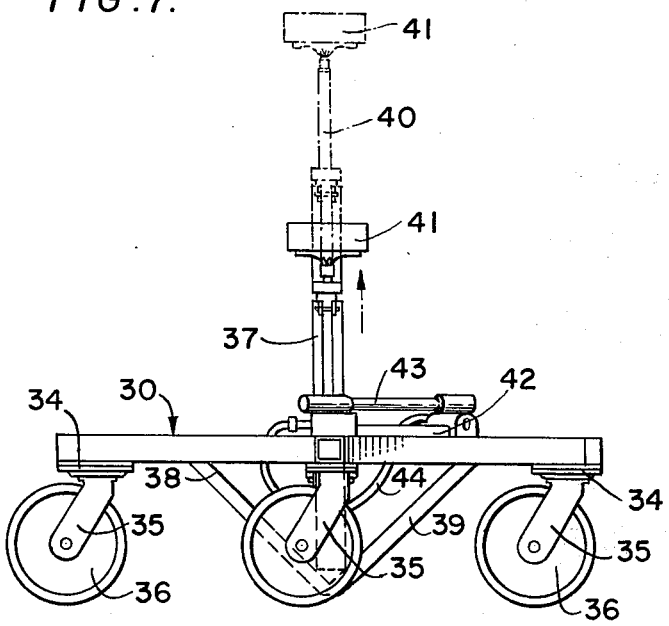
FIG. 7 is an elevation view of the dolly shown in FIG. 6.

As shown in FIG. 1, the flying truss deck form is being lowered onto a set of dollies, generally comprising four dollies 30, a detailed view of the dollies being shown in FIGS. 6 and 7. Each of the dollies 30 comprises a frame including outer frame members 31, which can be either triangular or rectangular, and which includes crossed frame members 32 and 33 extending from the corners of the frame. At the outer corners of the frame there are located caster-type assemblies each including a swivel 34 and a pair of spaced caster arms 35 carrying a floor engaging wheel 36. A hydraulic cylinder 37 is supported on the crossed frame members 32 and 33 at their intersection and extends below these frame members and is supported at its bottom by diagonal braces 38 and 39. The cylinder 37 has at least one upwardly extending rod 40 which can be raised and lowered by the cylinder for the purpose of raising and lowering a bracket 41 which is in the shape of a channel designed to receive and cradle the bottom chord 12 of a truss as shown for example in FIG. 2. The dolly is also provided with a hydraulic pump 42 which has a manual pump handle 43 extending therefrom for operation by a workman. Fluid pressure from the pump 42 is pumped through the tube 44 into the hydraulic cylinder 37 for the purpose of raising the rod 40 and bracket 41. Suitable valve means 45 is provided to permit the fluid pressure to drain back from the hydraulic cylinder 37 into the reservoir of the pump 42 so that the bracket 41 can also be lowered back down to its lowest position. The distance between the bottom peripheries of the wheels 36 and the uppermost position of the bracket 41 is great enough so that the hydraulic cylinder 37 can be used to fully raise the flying deck form 10 not only to the set position as shown in FIG. 3, but also to a position slightly thereabove to facilitate lowering of the jacks 20 before the final height adjustment is made by rotating the screw portions 26 of the shore jacks 20.

OPERATION

When a flying deck form is being moved to a new set position, it is generally lowered by a crane to which it is rigged into an approximate location between columns C. The crane lowers the deck form onto a set of dollies 30, placing the lower chord 12 of each truss directly upon a channel 41 on top of a dolly jack 37 as shown by the arrows A in FIG. 1. When so supported, the deck form 10 is as shown in FIG. 2, disconnected from the rigging R of the crane and located in the space between the columns C.

As shown in FIG. 3, the deck form 10 is then raised approximately to the desired height by a workman at each of the dollies 30, the workmen actuating the hand-pump 43 of each hydraulic pump 42 to pressurize the cylinder 37 and raise the rod 40 and bracket 41 upwardly. The four dollies then support the deck form 10 while workmen lower the jacks by pulling the pins 25, allowing the inner members 24 to slide downwardly to the desired height, reinserting the pins 25, and then turning the screw portions 26 of the jacks in order to position the deck form 10 at exactly the right height. The dollies can subsequently have their jacks 37 depressurized by opening the valves 45 and draining the jacks 37. The dollies are then removed to another location for use in setting the next deck form to be placed while the shore jacks 20 support the deck form 10 at the correct adjusted height. The new deck N is poured after workmen have completed putting in whatever smaller forms and shoring is required to join the flying deck forms together between and around the columns C in a manner well known per se in the trade.

After the new deck N has been poured and is sufficiently cured, the flying deck form 10 is then supported once more by the jacks as shown in the position of FIG. 3, while the shore jacks are being telescoped back up to their fully retracted positions in which the base plates 27 are in the dotted position shown in FIG. 8, namely, above the bottom edge of the chord member 12 of each truss. After the shore jacks 20 have all been raised out of the way, the dolly jacks 37 are then lowered by opening the valves 45 in their hydraulic systems to first strip the deck form 10 away from the concrete of the new deck N and then to lower the deck from further down once more to elevations corresponding to those shown in FIGS. 2 and 4. A form glide 15 is then placed at the edge of the building line, and the set of jacks nearest the form glide 15 are adjusted to place the ends of the deck form trusses on top of the rollers of the form glide 15. The jacks on the set of dollies nearest the form glide 15 are then retracted to a lower position, and the dollies are rolled out of the way. The deck form 10 is then pushed partially out of the building until it protrudes far enough for rigging to the crane again, preferably stopping in the position shown in FIG. 5 in which it is supported in over-balanced condition on the form glide 15 located below it and by a block B inserted between the deck form 10 and the lower side of the newly cured floor N. At this point the rigging R of the crane K is again attached through the openings 11 in the deck 10, and the form is flown in a manner well known per se to a new deck level where it is to be set for reuse in a new position.

This invention is not to be limited to the exact embodiments illustrated in the drawings, for obviously changes may be made therein within the scope of the following claims.

We claim:

1. Apparatus for handling a flying deck form for construction of successive floors supported on columns in a poured concrete building, the deck form having underlying trusses extending downwardly through a vertical height which is a substantial fraction of the separation between floor levels, the apparatus comprising:

a. a plurality of shore jacks having outer sleeve members vertically mounted in spaced relation on the trusses of the form and each ending above the bottoms of the trusses, and the jacks having slide members telescopically retractable upwardly within the sleeve members to a level above the bottoms of the trusses; and b. a plurality of dollies for supporting the deck forms and for moving them horizontally and vertically, each dolly comprising a frame having caster-mounted floor-engaging wheels; a dolly jack having a fixed jack member mounted vertically on the frame and having a movable jack member cooperating with said fixed member for vertical movement, and having truss-receiving means on said movable jack member for engaging the bottom of a truss; and means on the dolly for operating the dolly jack to raise the truss-receiving means from a downwardly retracted position in which its height above the floor plus the height of a truss is less than said separation between floor levels to an extended jack position in which the height of the truss-receiving means plus the height of a truss is at least as great as said separation between floor levels.

2. Apparatus as set forth in claim 1, wherein said shore jacks comprise long-extension jacks extendable to reach the floor when the deck form is raised to the level of the next floor to be poured, and the shore jacks including coarse adjustment means for changing their extension in step increments and fine adjustment means for changing their extension between said step increments.

3. Apparatus as set forth in claim 2, wherein each dolly jack comprises a long-stroke hydraulic jack whose fixed member comprises a cylinder and whose movable member comprises piston means telescopically received in said cylinder, and said operating means comprises hydraulic pump means mounted on the dolly and coupled to the cylinder and selectively operative to raise and lower said piston means.

4. Apparatus as set forth in claim 1, wherein said truss receiving means comprises an upwardly opening channel fixed to the top of said movable member and serving as a cradle to receive and support a truss.

* * * * *